United States Patent [19]

Byszewski et al.

[11] 4,408,141

[45] Oct. 4, 1983

[54] DUAL CATHODE BEAM MODE FLUORESCENT LAMP

[75] Inventors: Wojciech W. Byszewski, Arlington; A. Bowman Budinger, Westford; Joseph M. Proud, Wellesley Hills, all of Mass.

[73] Assignee: GTE Laboratories Incorporated, Waltham, Mass.

[21] Appl. No.: 337,046

[22] Filed: Jan. 4, 1982

[51] Int. Cl.[3] ..... H01J 23/16; H01J 29/96; H01J 7/44; H01J 13/46; H01J 17/34; H01J 19/78

[52] U.S. Cl. ..... 315/56; 313/306; 313/310; 313/350

[58] Field of Search ..... 315/56, 260, 334, 337, 315/DIG. 1; 313/306, 310, 350, 495

[56] References Cited

U.S. PATENT DOCUMENTS

| | | | |
|---|---|---|---|
| 2,441,863 | 5/1948 | Zabel | 313/629 |
| 2,946,909 | 7/1960 | Morehead | 313/43 |
| 3,013,169 | 12/1961 | Gungle et al. | 313/43 |

*Primary Examiner*—David K. Moore
*Assistant Examiner*—Robert E. Wise
*Attorney, Agent, or Firm*—J. Stephen Yeo; F. J. Bogacz

[57] ABSTRACT

The lamp shown herein is a beam mode fluorescent lamp for general lighting applications. The lamp comprises a light transmitting envelope, having a phosphor coating on its inner surface, enclosing a pair of thermionic electrodes and a fill material, such as mercury, which emits ultraviolet radiation upon excitation. During application of the first polarity of an AC signal, one electrode acts as a cathode and the other electrode functions as an anode. During the other AC polarity, the electrodes reverse their functions. This invention reduces the requirement for input power to a beam mode discharge lamp without adversely affecting luminous output. This lamp substantially eliminates wasted electron bombardment energy to the anode by use of this energy to help heat the cathode for the next half of the AC cycle. This lamp employs a single power source and may be used in various pre-heat or rapid start configurations.

11 Claims, 4 Drawing Figures

DUAL CATHODE BEAM MODE FLUORESCENT LAMP

CROSS REFERENCE TO RELATED APPLICATIONS

The present invention is an improvement to copending U.S. patent application Ser. No. 219,564, filed on Dec. 23, 1980, for a "Beam Mode Fluorescent Lamp", assigned to the same assignee. The present invention is also related to U.S. patent applications D23,282; D23,687; D23,665; D23,479 and D24,231, all assigned to the same assignee.

BACKGROUND OF THE INVENTION (1) Field of the Invention

The present invention pertains to beam mode discharge fluorescent lamps and more particularly to an arrangement for configuring the electrodes within a beam mode discharge fluorescent lamp.

(2) Description of the Prior Art

U.S. patent application Ser. No. 219,564, filed on Dec. 23, 1980, for a "Beam Mode Fluorescent Lamp", and assigned to the same assignee as the present invention, discloses a particular embodiment of a fluorescent lamp suitable for replacing the conventional incandescent bulb. Although incandescent lamps are inexpensive and convenient to use, they are considerably less efficient than fluorescent lamps.

In the above mentioned patent application, a single anode and cathode configuration is shown. This configuration requires three power terminals connecting the cathode and anode to the two power sources. In an alternate configuration in this application, a four terminal and two power source configuration is shown in which a heating filament is provided to heat the cathode for the production of electrons.

It is desirable to minimize the number of power sources and power connections from the power source to the anode and cathode of the fluorescent lamp. Thereby, the cost of the lamp is less. In addition, such a scheme provides for simpler assembly during manufacture.

More importantly, a portion of the energy, in the form of electrons, collected by the anode is dissipated as simple heat by the anode. As a result, illuminating efficiency of such a lamp is diminished.

SUMMARY OF THE INVENTION

Accordingly, it is an object of the present invention to provide a beam mode fluorescent lamp in which wasted anode heating is utilized to provide additional heating for electron emission of a cathode.

It is another object of the present invention to provide a beam mode fluorescent lamp in which the number of power sources and of power terminals is minimized.

The subject beam mode fluorescent lamp includes a light transmitting envelope enclosing a fill material, which emits ultraviolet radiation upon excitation. A phosphor coating on an inner surface of the envelope emits visible light upon absorption of ultraviolet radiation.

Two thermionic electrodes for emitting electrons are located within the envelope, each electrode has first and second ends. Each electrode is connected between an associated pair of conductors. The electrodes extend lengthwise and parallel to one another in the same horizontal plane, although any orientation of the plane would be functional. One conductor of each electrode is connected to an AC power source. The other conductor of each electrode is connected to a start circuit. These conductors also serve to support the electrodes at a stationary location within the envelope.

Each electrode functions as both an anode and cathode under the two alternating polarities of an applied AC voltage. On the first half cycle of the AC voltage, the electrode with the positive polarity voltage functions as an anode to accelerate an electron beam which was formed by the electrode with the negative polarity functioning as a cathode to emit electrons forming the electron beam. The accelerated electron beam then enters a drift region.

On the alternate half cycle of the AC voltage, the electrode which functioned as an anode, now functions as the cathode to emit a second electron beam in the opposite direction to that of the first electron beam. The other electrode which previously operated as a thermionic cathode, now operates as an anode to accelerate electrons of the second electron beam into a second drift region.

On each half cycle of the AC voltage, the electrode which is functioning as the anode, collects electrons. This current would usually be dissipated as simple heat. However, since the anode of the present half cycle is the cathode for the next half cycle, this current serves to heat the cathode for a more effective emission of electrons. This heat is usually wasted, but here it is used for keeping the cathodes heated suitably for electron emission.

The first and second electron beams alternately drift through two drift regions within the envelope after passing their respective anodes on alternate half cycles of the AC voltage. Electrons in each electron beam collide with atoms of the fill material in the corresponding drift region, thereby causing excitation of a portion of the fill material atoms and emission of ultraviolet radiation and causing ionization of respective portions of the fill material atoms thereby yielding secondary electrons. These secondary electrons cause further emissions of ultraviolet radiation. The fill material typically includes mercury and a noble gas.

Each electrode is spaced apart from the other electrode by a distance which is comparable to or somewhat less than the electron range in the fill material, approximately one centimeter. The structure of each electrode when functioning as an anode permits acceleration of an electron beam, with the amount of electrons collected by to the anode minimized.

The lamp includes a base which encloses the start circuit and power source. Both conventional pre-heat and rapid start circuits may be employed as the start circuit of the present invention.

DESCRIPTION OF THE PREFERRED EMBODIMENT

Figure 1:
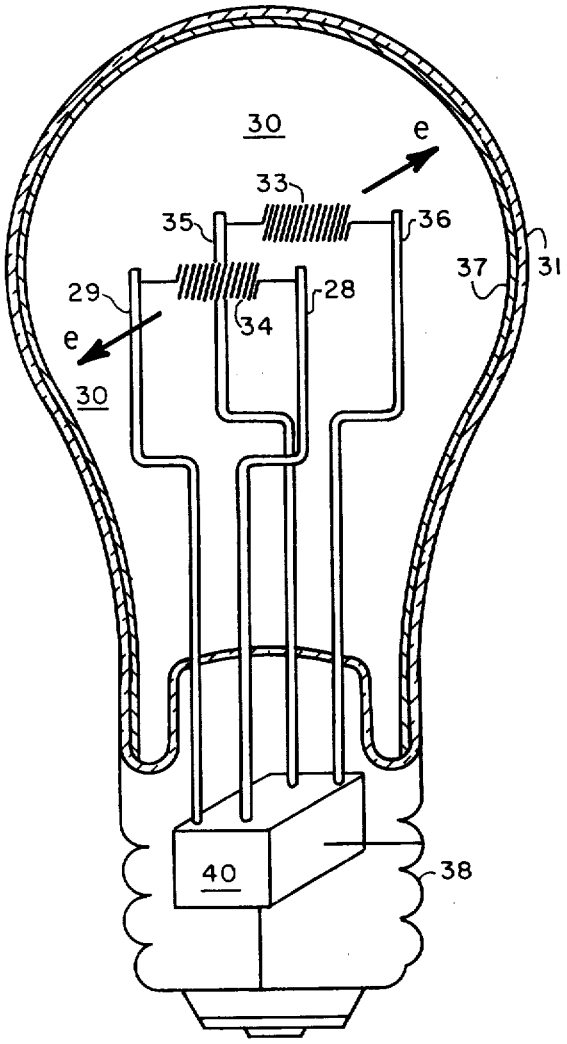
FIG. 1 is a perspective view of a schematic diagram of a dual cathode beam mode fluorescent lamp embodying the present invention.

Referring to FIG. 1, a beam mode fluorescent lamp according to the present invention is shown. A vacuum type lamp envelope 31 made of a light transmitting substance, such as glass, encloses a discharge volume. The discharge volume contains a fill material which emits ultraviolet radiation upon excitation. A typical fill material includes mercury and a noble gas or mixtures of noble gases. A suitable noble gas is neon. The inner surface of the lamp envelope 31 has a phosphor coating 37 which emits visible light upon absorption of ultraviolet radiation. Also enclosed within the discharge volume of the envelope 31, is a pair of electrodes 33 and 34. These electrodes 33 and 34 function alternately as anode and cathode. At one particular time, one is an anode and the other is a cathode.

Electrode 33 is connected between conductors 35 and 36 and electrode 34 is connected between conductors 28 and 29. Each of the conductors is of the same particular height so that the two electrodes 33 and 34 lie in the same horizontal plane. The electrodes 33 and 34 are oriented lengthwise parallel and spaced approximately one centimeter apart.

Supporting conductors 28 and 36 connect electrodes 34 and 33 respectively, through enclosure 40 to the AC power supply, and conductors 29 and 35 connect the other ends of electrodes 34 and 33 respective to a start circuit also located in enclosure 40. Conductors 28, 29, 35 and 36 provide for the above mentioned connections through the envelope 31 in a vacuum tight seal, as well as providing support for electrodes 33 and 34. Electrodes 33 and 34 are typically of a 20 volt thermionic type.

The lamp further includes a base 38 which is of a conventional type, suitable for inserting into an incandescent lamp socket.

After the start circuit is activated by switching the lamp on, an AC voltage is applied to electrodes 33 and 34. On the first half cycle of the AC voltage, electrode 33 will be at a positive polarity with respect to electrode 34. As a result, electrode 34 will function as a thermionic cathode to emit electrons, thereby forming an electron beam as shown. Electrode 33 will function as an anode and operate to accelerate the electron beam into a corresponding first drift region 30.

On the alternate half cycle of the AC voltage, electrode 34 will be positive with respect to electrode 33. Then, electrode 33 will function as a thermionic cathode to emit electrons forming a second electron beam, as a result. Electrode 34 will operate as an anode and accelerate the formed electron beam into a corresponding second drift region 30.

The two drift regions 30 are located within the envelope 31 and extend in the direction of electron beam flow indicated, after passing their respective anodes on alternate half cycles of the AC voltage. Electrons in each region collide with atoms of the fill material, thereby causing excitation of a portion of the fill material atoms and emission of ultraviolet radiation and causing ionization of respective portions of the fill material atoms thereby yielding secondary electrons. These secondary electrons cause further emissions of ultraviolet radiation.

It is to be noted that the cathode heating current and the discharge current between electrodes 33 and 34 are both derived from the same power source of enclosure 40. Only a single power source is required for the two functions. Power source 40 comprises a step-down transformer, which lowers the applied voltage to approximately 20 volts.

Due to the alternating cathode-anode interchange of electrodes 33 and 34, the electrons which are collected by the particular electrode which is presently functioning as an anode will serve to heat this anode. However, the anode of the present half cycle is the cathode of the next half cycle. This heat stimulates the emission of electrons of the next half cycle by keeping a constant heat level and supplementing the ohmic heating provided by the power source.

The lamp disclosed herein provides substantially more efficiency than a similar 100 watt incandescent lamp. The 100 watt incandescent lamp provides approximately 17 lumens/watt and a single electrode incandescent replacement (such as U.S. patent application Ser. No. 219,564) provides about 25 lumens/watt. However, the present dual cathode beam mode fluorescent lamp was found to yield about 35 lumens/watt, an improvement of about 40%.

Figure 2A:
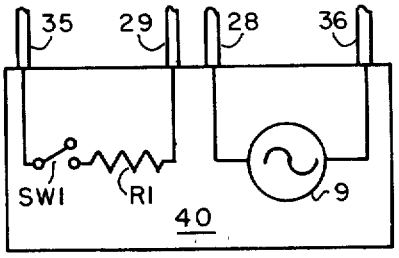
FIGS. 2A, 2B and 2C illustrate various start circuits which may be employed in realizing the dual cathode beam mode fluorescent lamp of the present invention.
Figure 2B:
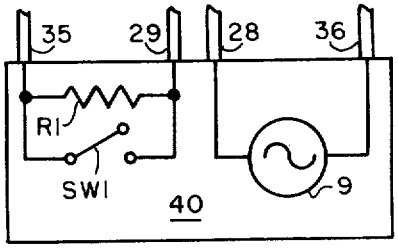
Figure 2C:
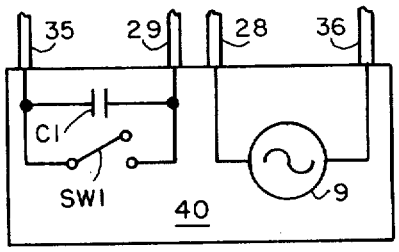

Referring now to FIGS. 2A through 2C, various starting circuits are shown along with the connection of the AC voltage source 9. AC voltage source 9 is connected between conductors 29 and 36 so that electrodes 33 and 34 of FIG. 1 are alternately, one positive and the other negative. FIG. 2A shows a pre-heat start circuit connected between conductors 35 and 29. This pre-heat start circuit is a series connection of a switch SW1 and resistor R1. FIG. 2B depicts a rapid start circuit composed of a resistor R1 and switch SW1, each connected in shunt to conductors 35 and 29. FIG. 2C shows another rapid start circuit comprising a shunt connection of a capacitor C1 and switch SW1 across conductors 35 and 29. The pre-heat and rapid start circuits shown above are all of a conventional nature.

Although a preferred embodiment of the invention has been illustrated, and that form described in detail, it will be readily apparent to those skilled in the art that various modifications may be made therein, without departing from the spirit of the invention or from the scope of the appended claims.

What is claimed is:

1. A dual cathode beam mode fluorescent lamp comprising:

a light transmitting envelope enclosing a fill material which emits ultraviolet radiation upon excitation;

an AC power source external to said envelope;

a phosphor coating, which emits visible light upon absorption of ultraviolet radiation, on an inner surface of said envelope;

a start circuit;

a first and a second thermionic electrode, each of said electrodes located within said envelope and each having first and second ends;

first means for connecting said first ends of each of said first and second electrodes to said power source;

second means for connecting said second ends of each of said first and second electrodes to said start circuit;

said first and second electrodes oriented lengthwise and parallel to each other;

said first and second electrodes operated in response to a first polarity of said AC power source so that, said first electrode operates as a thermionic cathode for emitting electrons and said second electrode operates as an anode for accelerating said electrons and forming a first electron beam;

said first and second electrodes alternately operated in response to a second polarity of said AC power source so that, said second electrode operates as a thermionic cathode for emitting electrons and said first electrode operates as an anode for accelerating said electrons and forming a second electron beam in a direction generally opposite to that of said first electron beam;

said first and second electrodes further operated so that during said first polarity of said AC power source, said second electrode is heated for subsequent operation as a cathode by said collected electrons of said first electron beam and alternately during said second polarity of said AC power source, said first electrode is heated for subsequent operation as a cathode by said collected electrons of said second electron beam;

first and second drift regions, each located within said envelope through which said first and said second electron beams drift after passing said first and said second anodes respectively, each of said drift regions having a dimension in the direction of travel of said respective electron beam which is greater than the electron range in said fill material, whereby the electrons in each of said drift regions collide with the atoms of said fill material, thereby causing excitation of first and second respective portions of said fill material atoms and emission of ultraviolet radiation and causing ionization of other portions of said fill material atoms thereby yielding secondary electrons, said secondary electrons causing emission of additional ultraviolet radiation.

2. A dual cathode beam mode fluorescent lamp as claimed in claim 1, wherein each of said electrodes is spaced apart from said other by a distance which is approximately equal to or somewhat less than the electron range in said fill material.

3. A dual cathode beam mode fluorescent lamp as claimed in claim 1, wherein each of said electrodes has a structure which generally permits said first and second electron beams to pass with minimal collection.

4. A dual cathode beam mode fluorescent lamp as claimed in claim 1, wherein said first and second electrodes lie in a horizontal plane.

5. A dual cathode beam mode fluorescent lamp as claimed in claim 1, wherein said fill material includes mercury and a noble gas.

6. A dual cathode beam mode fluorescent lamp as claimed in claim 5, wherein said noble gas includes neon.

7. A dual cathode beam mode fluorescent lamp as claimed in claim 1, wherin there is further included a lamp base enclosing said power source and said start circuit, whereby said lamp can be operated directly from AC power.

8. A dual cathode beam mode fluorescent lamp as claimed in claim 1, wherein said power source provides power for heating said electrodes and simultaneously for providing a potential difference between said electrodes.

9. A dual cathode beam mode fluorescent lamp as claimed in claim 1, wherein said start circuit is a preheat start circuit including a switch and resistor series connected to said second means for connecting.

10. A dual cathode beam mode fluorescent lamp as claimed in claim 1, wherein said start circuit is a rapid start circuit including a switch and a resistor connected in shunt to said second means for connecting.

11. A dual cathode beam mode fluorescent lamp as claimed in claim 1, wherein said start circuit is a rapid start circuit including a switch and a capacitor connected in shunt to said second means for connecting.

* * * * *